US007493716B2

(12) United States Patent
Brown et al.

(10) Patent No.: US 7,493,716 B2
(45) Date of Patent: Feb. 24, 2009

(54) SIGNAGE SYSTEM WITH HIDDEN ATTACHMENT SYSTEM

(75) Inventors: Lee S. Brown, Montague, MI (US); Jamie S. Hossink, Muskegon, MI (US); Paul Franklyn, Muskegon, MI (US)

(73) Assignee: Whitehall Products, LLC, Montague, MI (US)

( * ) Notice: Subject to any disclaimer, the term of this patent is extended or adjusted under 35 U.S.C. 154(b) by 355 days.

(21) Appl. No.: 11/209,155

(22) Filed: Aug. 22, 2005

(65) Prior Publication Data

US 2007/0113447 A1 May 24, 2007

(51) Int. Cl.
*G09F 1/08* (2006.01)
*G09F 7/00* (2006.01)

(52) U.S. Cl. ..... 40/538; 40/596

(58) Field of Classification Search ..... 40/538, 40/539, 596, 584, 616, 552
See application file for complete search history.

(56) References Cited

U.S. PATENT DOCUMENTS

| | | | | |
|---|---|---|---|---|
| 672,751 | A | 4/1901 | Caesar | |
| 768,179 | A | 8/1904 | Hotchner | |
| 2,254,498 | A | 9/1941 | Scharf | |
| 2,314,803 | A | 3/1943 | Wagner et al. | |
| 2,785,490 | A * | 3/1957 | Fabry | 40/711 |
| 2,835,060 | A | 5/1958 | Staaf | |
| 2,870,558 | A * | 1/1959 | Fuller | 40/538 |
| 3,063,199 | A | 11/1962 | Marcin | |
| 3,089,269 | A | 5/1963 | McKiernan | |
| 3,117,045 | A | 1/1964 | Schwickert | |
| 3,258,869 | A | 7/1966 | Ownbey | |
| 3,464,134 | A | 9/1969 | Franklin | |
| 3,484,974 | A | 12/1969 | Culmone | |
| 3,651,592 | A | 3/1972 | McCormick et al. | |
| 3,683,461 | A | 8/1972 | Weidemann | |
| 3,965,597 | A | 6/1976 | Noellert | |
| 3,987,568 | A | 10/1976 | Rosenberg | |
| 4,014,118 | A | 3/1977 | Robinet et al. | |
| 4,467,543 | A * | 8/1984 | Townsend | 40/624 |
| 5,090,146 | A | 2/1992 | Sandefur | |
| 5,230,175 | A | 7/1993 | Follis | |
| 5,329,717 | A | 7/1994 | Follis | |
| 5,555,660 | A | 9/1996 | Whitehouse et al. | |
| 6,385,840 | B1 | 5/2002 | Scarfia | |
| 6,668,476 | B1 | 12/2003 | Gaines et al. | |
| 6,821,593 | B2 | 11/2004 | Maggio et al. | |
| 2004/0055197 | A1 | 3/2004 | House | |
| 2004/0139638 | A1 | 7/2004 | Liao | |

* cited by examiner

*Primary Examiner*—Cassandra Davis
(74) *Attorney, Agent, or Firm*—Price, Heneveld, Cooper, DeWitt & Litton LLP

(57) ABSTRACT

A signage system includes an alpha-numeric character with angled front walls defining a peaked internal cavity and having perimeter flanges extending along edges of the front walls. A mount plate fits into and is hidden by the character. Connectors releasably attach the character to the mount plate. Features on the mount plate and character inter-engage to center and align the character on the mount plate. The connectors can be snap-attach, hook-and-loop, or magnetic. Alternatively, adhesive can be used to attachment.

18 Claims, 4 Drawing Sheets

SIGNAGE SYSTEM WITH HIDDEN ATTACHMENT SYSTEM

BACKGROUND

The present invention relates to a signage and display system having a three-dimensional hollow body treated for aesthetics and having a mount attachable to a support structure such as a building wall.

Three-dimensional signage is often used on buildings and in other environments so that the signage can be read when viewed at an angle, such as when people pass by the front of a building. A problem is that the signage must be very securely mounted to the support structure (i.e., a building wall or sign-supporting understructure) so that individual characters do not come loose and/or tilt over time, because any loose or oddly-angled letter creates a noticeably poor appearance giving rise to concerns about the quality of the building and concerns about the quality and competence of businesses therein. At the same time, the signage should preferably be easy to install and to repair. Another factor is that the signage industry is very competitive, such that cost and durability of components and cost of installation are very important.

Some existing signage uses a mounting component adapted for attachment to a building wall or flat support structure, and an aesthetic body adapted to attach to the mounting component. For example, see Weidemann U.S. Pat. No. 3,683,461 and Wagner U.S. Pat. No. 2,314,803. However, improvements are desired so that the signage is more easily installed, and so that once installed, the signage components are positively centered and well-aligned with other characters in the signage system. In particular it is noted that it is relatively difficult to locate a plurality of fastener-receiving connectors in a pattern on a building wall with enough accuracy to closely match the pattern of connectors on a signage component. Thus, installation is "always" difficult, with some fasteners not lining up with their mating fastener-receiving member, or their holding with substantially less power than others, and with still other fasteners basically not holding at all. Also, improvements are desired so that separate mounts can be used that are optimally suited for attachment to a building wall (or support structure), yet that when attached, are well hidden from view by the aesthetic character that they support. In particular, a signage system is desired where the mount is basically not visible (or at least is barely visible) even when viewed at a sharp angle. At the same time, a signage system is desired that is flexible and well adapted for use with different attachment systems.

Thus, a signage system having the aforementioned advantages and solving the aforementioned problems is desired.

SUMMARY OF THE PRESENT INVENTION

In one aspect of the present invention, a signage system includes a hollow body defining a rearwardly-open cavity, a mount plate having a shape similar to the cavity and adapted to fit at least partially into the cavity with lateral clearance, and connectors for securing the hollow body to the mount plate. Centering surfaces separate from the connectors are provided on one of the hollow body and the mount plate, the centering surfaces being configured to engage the other of the hollow body and the mount plate to center and align the hollow body on the mount plate.

In another aspect of the present invention, a signage system includes a hollow body having a non-planar face wall defining a peak, and a perimeter flange defining a rearwardly-open cavity with a deep portion at the peak. A mount plate is provided having a shape configured to fit at least partially into the cavity to a location substantially hidden by the perimeter flanges. Connectors are also provided for securing the hollow body to the mount plate, the connectors including at least one connector head spaced inboard from the perimeter flange and that extends above the mount plate into the deep portion.

In another aspect of the present invention, a signage system includes an alpha-numeric character with angled front walls defining a peak and an internal cavity. Perimeter flanges extend rearwardly along edges of the front walls. A mount plate is shaped to fit within the cavity and be visually hidden by the character. The mount plate includes holes for receiving screws to attach the mount plate to a support surface, the mount plate and character each including aligned pairs of discrete mounting features. A connector is mounted in one of each of the pairs of discrete mounting features. The connector has an exposed end configured to engage the other one of each of the pairs of discrete mounting features for attaching the character to the mount plate. The perimeter flanges define with the angled front walls a corner, and the mount plate is shaped to fit against the corner to align the character on the mount plate.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
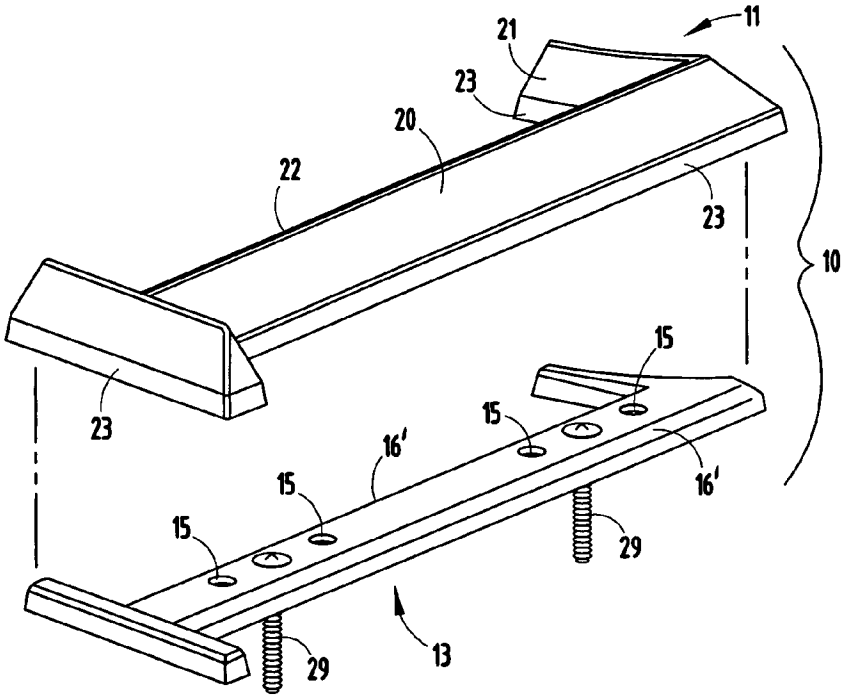
Figure 6:
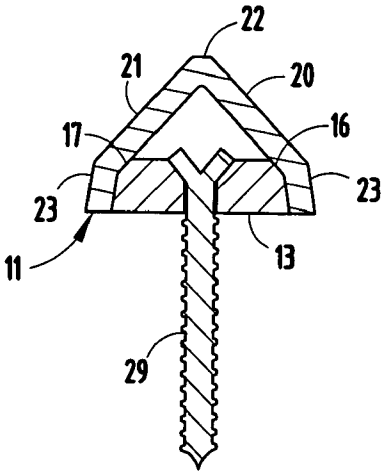
FIGS. 6-7 are cross-sectional views taken along lines VI-VI and VII-VII in FIG. 5.
Figure 7:
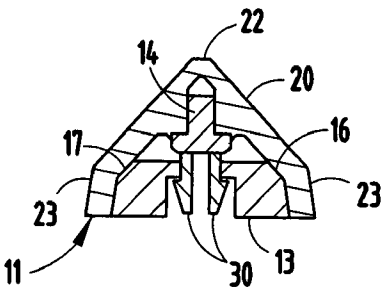
Figure 5:
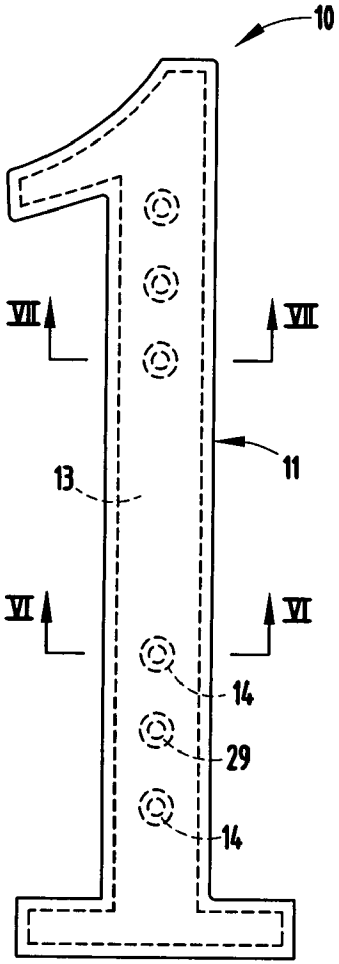
FIG. 5 is a front view of the assembly of FIG. 1.
Figure 9:
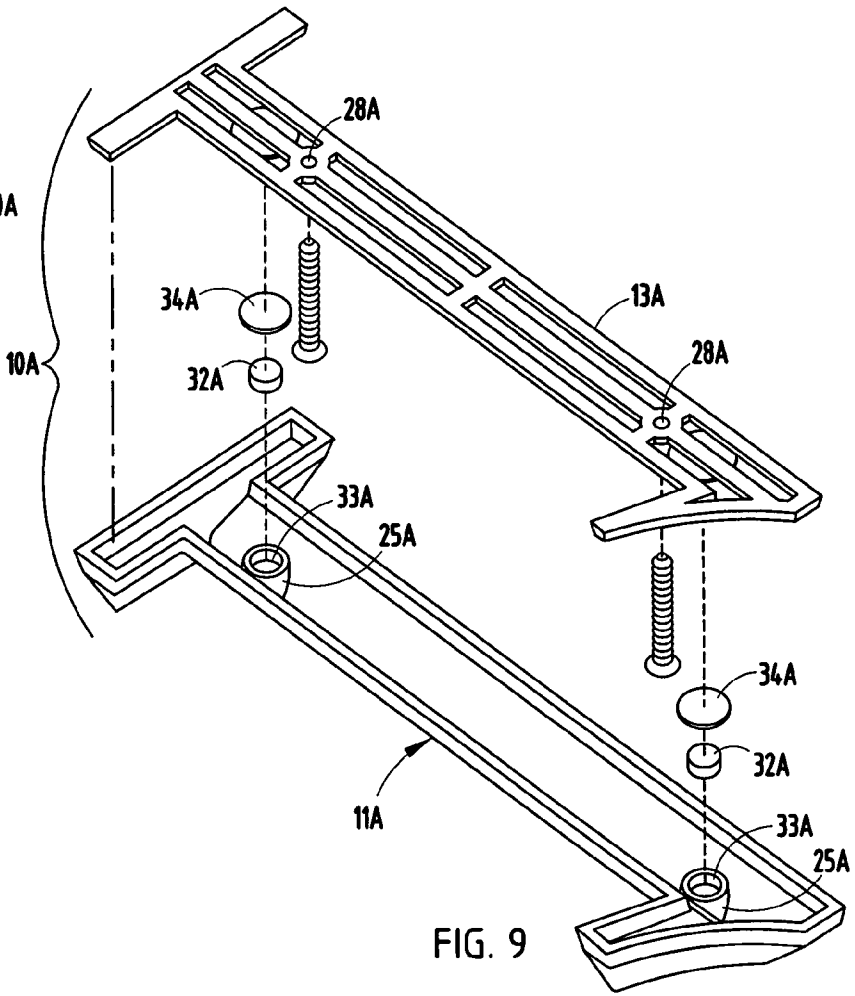
FIGS. 8-9 are exploded perspective views of a second embodiment of an aesthetic hollow body and mount plate.
Figure 8:
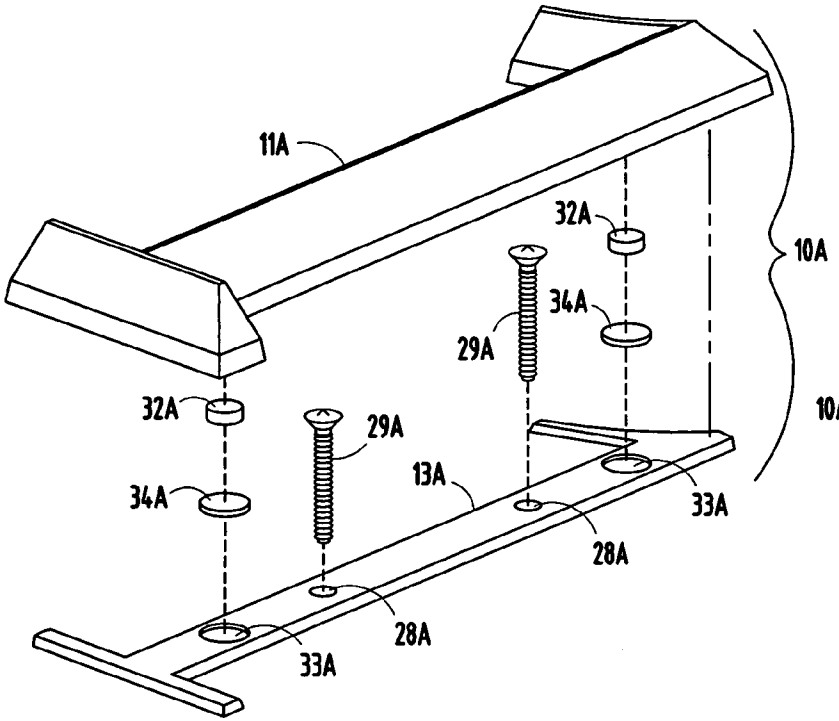

A signage/display system 10 (FIG. 1) (hereafter called "signage") includes a hollow body 11 with an aesthetically treated front forming an alpha-numeric character or symbol mounted on a mount plate 13 by connectors 14-15. The hollow body 11 defines a rearwardly-open cavity 12, and the mount plate 13 has a shape similar to and adapted to fit within the cavity 12 with lateral clearance. The connectors 14-15 are configured to secure the hollow body 11 to the mount plate 13 with a snap-attach design. Centering surfaces 16-17 (FIGS. 6-7) are formed on angled portions of the hollow body 11 that are configured to engage corners/edges 16' of the mount plate 13 to center and align the hollow body 11 on the mount plate 13. By this arrangement, the mount plate 13 provides an improved attachment system which is hidden from view, such that it creates an aesthetic attractive design that facilitates accurate and easy assembly. At the same time, the assembly assures good alignment with adjacent signage characters.

The illustrated hollow body 11 is made from a cast metal, but it is contemplated that the present invention is broad enough such to include any durable robust material suitable for the environment of intended use, such as other metals, composites, reinforced materials, surface-finished materials, and many plastics. The hollow body 11 can be in the shape of any signage/display character, such as an alpha-numeric number, any letter, any symbol, or in the shape of any other character for acting as signage or display to convey information to a passerby. The illustrated hollow body 11 is the number "1", which has a long narrow shape with end features of interest. Specifically, it is a cast brass having a front surface polished and treated for optimal appearance and durability for outside use. The hollow body 11 includes a front wall including angled wall portions 20 and 21 forming a flat-topped or rounded peak 22 visible from multiple angles, with perimeter flanges 23 extending rearwardly that are shaped to visually hide the mounting plate 13. The components 20-23 form the cavity 12, and define an internal peak 24.

Figure 2:
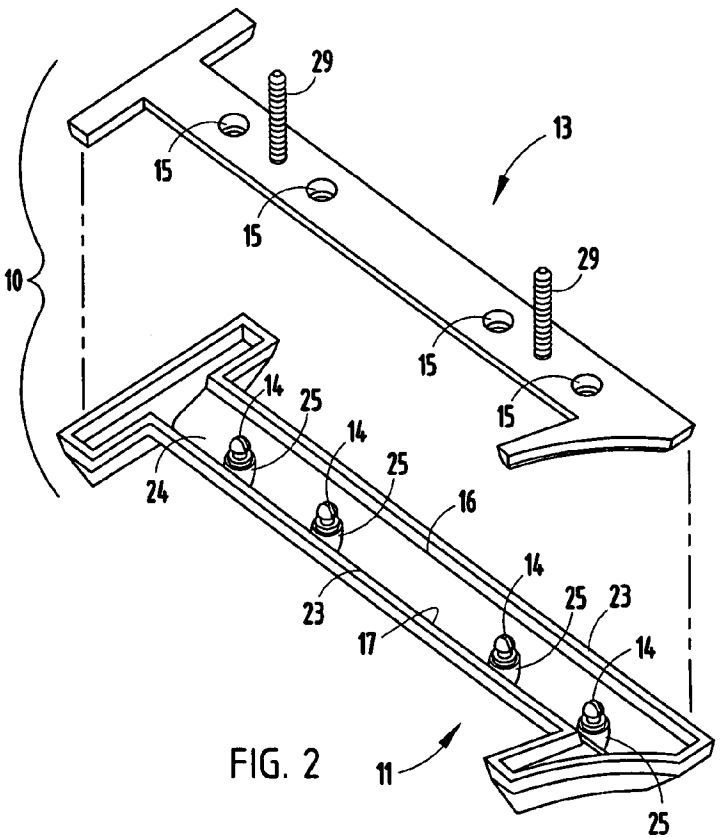
FIGS. 1-2 are exploded perspective views of an aesthetic hollow body and mount plate.
Figure 4:
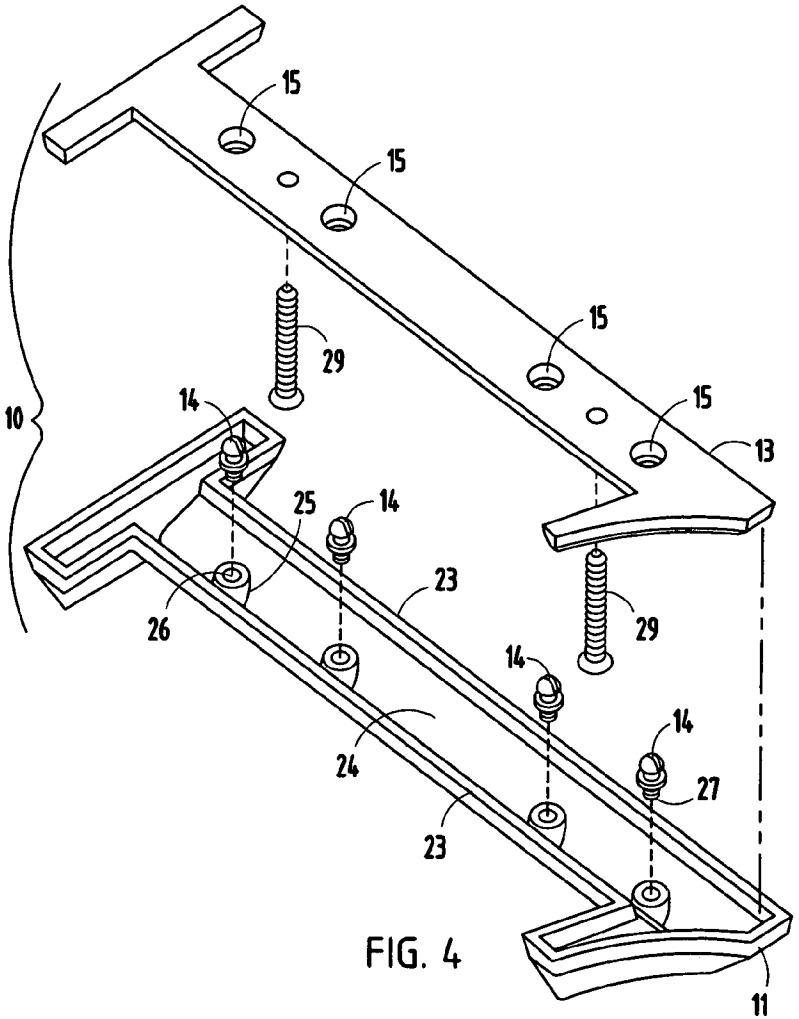
FIGS. 3-4 are exploded perspective views of FIG. 1-2, respectively, but with fasteners exploded away from respective components.
Figure 3:
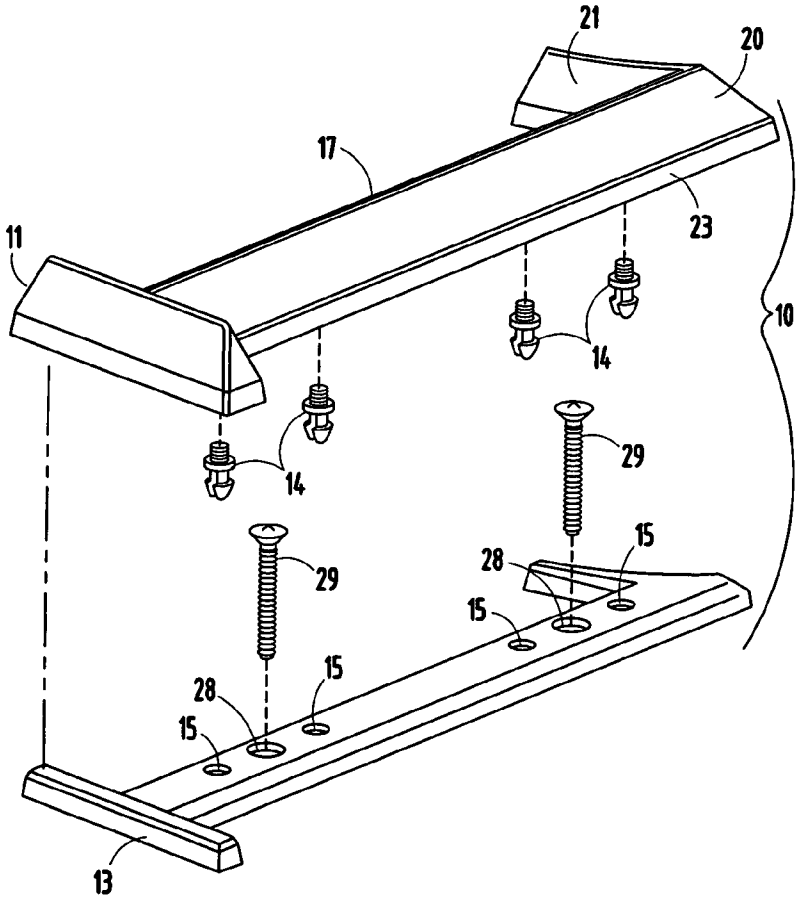
Figure 11:
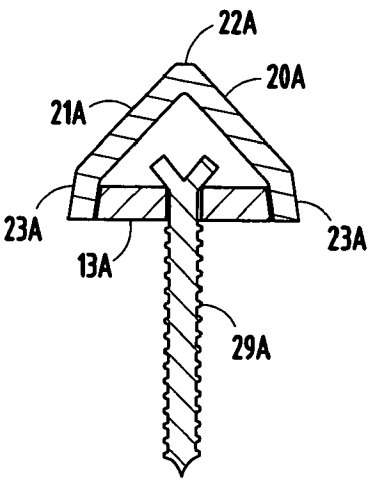
FIGS. 11-12 are cross-sectional views taken along lines XI-XI and XII-XII in FIG. 10.
Figure 12:
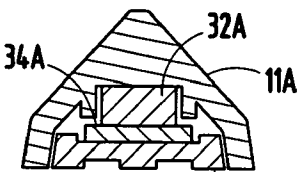
Figure 10:
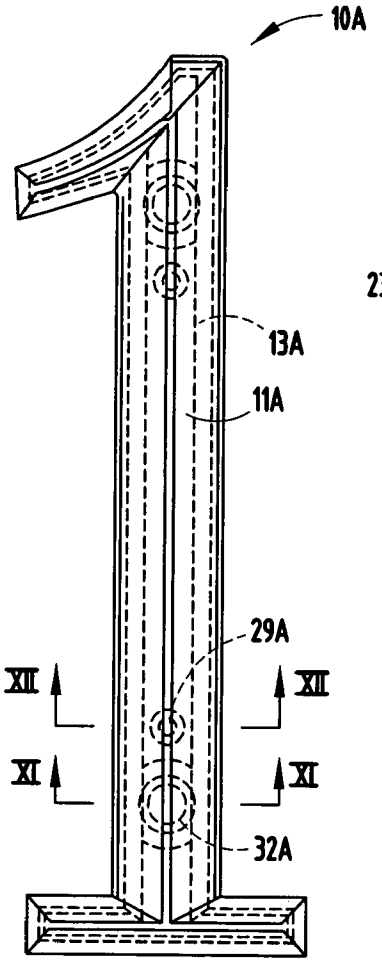
FIG. 10 is a front view of the assembly of FIG. 8.

A plurality of hollow bosses 25 (four bosses being illustrated in FIG. 2) are formed at spaced-apart locations periodically along the interior cavity, the illustrated bosses 25 being spaced along locations on the internal peak 24. Each of the bosses 25 include an aperture 26 (FIG. 4) configured to threadingly frictionally engage and retain a threaded end 27 of the snap connectors 14 (sometimes also referred to as "snap post" connectors). The bosses 25 are supported by reinforcement ribs that extend from sides of the bosses 25 to the side wall portions 20 and 21 and/or to the perimeter flanges 23. The threaded end 27 can be self-tapping or configured to engage pre-cut threads in the bosses 25. It is also contemplated that other means of attachment can be used other than threads, such as press-fit, adhesive, material bonding techniques, and the like. When installed, the resilient prongs 30 of the connectors 14 extend from the hollow body 11 in a direction for frictionally engaging the apertures connectors 15 on the mount plate 13. Nonetheless, it is noted that the connectors 14 provide sufficient ability for the corners of the mount plate 13 to engage the angled wall portions 20 and 21 and/or perimeter flanges 23 for the purpose of centering the hollow body 11 on the mount plate 13.

The mount plate 13 is shaped similarly to the cavity 12 and is configured to fit within the cavity 12. It is contemplated that the mount plate can extend along all of the cavity 12, or that it can extend along limited portions of the cavity. The mount plate 13 is relatively flat such that it is easily formed by stamping or molding for competitive cost. Further, the mount plate 13 can be made of a cost-competitive materials, such as rust-resistant coated/treated metal or plastic. The mount plate 13 is a stamped metal component and includes first holes (i.e., connector 15) forming the connector structure for receiving and engaging the connectors 14, and includes second holes 28. The holes 28 are shaped to receive mounting screws 29 for attachment to a base surface, such as to the exterior of a cement wall or masonry wall of a building. The illustrated holes 28 are chamfered on the front side so that the head of the screws 29 fits therein. However, it is noted that a height of the internal peak 24 allows the screw head to extend above the mount plate 13 without creating an interference (see FIG. 6). The illustrated connectors 14 include opposing resilient prongs 30 (FIGS. 2 and 7) shaped to mechanically frictionally releasably engage the apertured connectors 15.

In use, the mount plates 13 are affixed in aligned and spaced positions to the building wall or other substrate, and the snap post connectors 14 are affixed to the number (hollow body 11). The hollow bodies 11 are then positioned and pressed against their respective mount plates 13 until snappingly engaged and held by inter-engagement of the connectors 14 and 15, with outer corners of the mount plate engaging the angled wall portions 20-21 and/or the perimeter flanges 23 for the purpose of centering and aligning the hollow bodies (11). When installed, the perimeter flanges 23 visually hide the mount plate 11, even when viewed from a side angle, thus providing a very attractive visible signage character while allowing use of (i.e., the advantages of having) a separate mount plate attached to the building wall or support structure.

Modifications are discussed below using the same numbers for identical or similar components, features, and characteristics, but with the addition of the letter "A". This is done to reduce redundant discussion, but not for another purpose.

A modified signage 10A (FIGS. 8-12) includes a hollow body 11A and mount plate 13A, but the connectors (14 and 15) are modified to include magnets 32A attached in a pocket-forming end 33A of the bosses 25A. The illustrated mount plate 13A includes a pair of magnetic plugs 34A that optimally attract and attach to the magnet 32A. Nonetheless, it is contemplated that the mount plate 13A can be made of a material attractive to the magnets 32A such that a separate plug may not be needed. The illustrated bosses 25A are enlarged sufficiently to receive the magnet 32A with an outer surface of the magnet 32A rising above the end of the bosses 25A. It is noted that two spaced-apart magnets 32A hold very well, and further that they are able to accommodate significant weight and also accommodate significant variation in the location of the bosses relative to the mating area on the mount plate 13A.

In addition to the mechanical releasable (snap-post) connector arrangement (i.e., connectors 14/15) and also the magnetic releasable connector arrangement (i.e., connectors 32A/34A), the present invention is well adapted for use with a variety of different connectors. For example, it is contemplated that the connector arrangement could include hook-and-loop material (such as "VELCRO™"), with mating connector parts positioned in the cavity of the hollow body and on the attachment points of the mount plate. The connector parts could be single individual patches, or could be one or more long strips. Alternatively, adhesive could be used. For example, the adhesive could be a single spot of adhesive on the end of the bosses on the hollow body, the adhesive being located and adapted to bond to the mount plate upon being pressed together. Alternatively, the adhesive could be a tacky-type adhesive permitting releasable attachment. Also, the adhesive could be in the form of opposing patches of double-sided sticky tape attached to the end of the bosses on the hollow body and to the aligned locations on the mount plate that bond together once the hollow body is positioned on and engaged with the mount plate. The connector parts could be releasably attached (i.e., separatable) or could be permanently attached arrangements.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A signage system comprising:

a hollow body defining a rearwardly-open cavity;

a mount plate having a shape similar to the cavity and adapted to fit at least partially into the cavity with lateral clearance;

connectors for securing the hollow body to the mount plate; and centering surfaces separate from the connectors on one of the hollow body and the mount plate that engage the other of the hollow body and the mount plate to center and align the hollow body on the mount plate;

wherein the hollow body includes perimeter flanges that define a boundary of the cavity, and wherein the mount plate is positioned at least partially within the cavity so that the mount plate is at least partially hidden from view by the perimeter flanges; and wherein the hollow body defines an internal peak, and wherein the connectors include a headed end that extends toward the internal peak.

2. The signage system defined in claim 1, wherein the hollow body defines an alpha-numeric symbol.

3. The signage system defined in claim 2, wherein the hollow body includes a non-planar front show surface treated for aesthetics.

4. The signage system defined in claim 3, wherein the hollow body includes cast metal.

5. The signage system defined in claim 1, wherein the connectors releasably engage to permit removal of the hollow body from the mount plate.

6. The signage system defined in claim 5, wherein the connectors include first and second connector structures that mechanically attach.

7. The signage system defined in claim 1, wherein the connectors include a resilient portion that mechanically frictionally engages with a snap-attach action during installation.

8. The signage system defined in claim 1, wherein the connectors include adhesive.

9. The signage system defined in claim 1, wherein the hollow body includes angled wall portions, and wherein the centering surfaces are formed at least in part on an inside of the angled wall portions.

10. A signage system comprising:

a hollow body including a non-planar face wall defining a peak and a perimeter flange defining a rearwardly-open cavity with a deep portion at the peak;

a mount plate having a shape configured to fit at least partially into the cavity to a location substantially hidden by the perimeter flanges; and connectors for securing the hollow body to the mount plate including at least one connector head spaced inboard from the perimeter flange and that extends above the mount plate into the deep portion.

11. The signage system defined in claim 10, wherein the hollow body defines a three-dimensional alpha-numeric character.

12. The signage system defined in claim 10, wherein the hollow body is a cast metal having an aesthetically treated show surface.

13. The signage system defined in claim 10, wherein the connectors are releasably engaged.

14. The signage system defined in claim 13, wherein the connectors mechanically attach.

15. The signage system defined in claim 13, wherein the connectors include a resilient portion that snappingly engages.

16. The signage system defined in claim 10, wherein the hollow body includes perimeter flanges that define a boundary of the cavity, and wherein the mount plate is positioned at least partially within the cavity where the mount plate is at least partially hidden from view by the perimeter flanges.

17. The signage system defined in claim 16, wherein the hollow body and the mount plate include inter-engaging centering surfaces that abuttingly center the hollow body on the mount plate when in an installed position on the mount plate.

18. The signage system defined in claim 17, wherein the centering surfaces include opposingly angled surfaces.

* * * * *